US010597186B2

(12) United States Patent
Arrington

(10) Patent No.: US 10,597,186 B2
(45) Date of Patent: Mar. 24, 2020

(54) PRODUCE LABEL PRINTER AND APPLICATOR

(71) Applicant: John Bean Technologies Corporation, Chicago, IL (US)

(72) Inventor: Clint P. Arrington, Lakeland, FL (US)

(73) Assignee: John Bean Technologies Corporation, Chicago, IL (US)

( * ) Notice: Subject to any disclaimer, the term of this patent is extended or adjusted under 35 U.S.C. 154(b) by 0 days.

(21) Appl. No.: 16/014,867

(22) Filed: Jun. 21, 2018

(65) Prior Publication Data

US 2019/0389614 A1 Dec. 26, 2019

(51) Int. Cl.

| | |
|---|---|
| ***B65C 9/46*** | (2006.01) |
| ***B65C 9/02*** | (2006.01) |
| ***B65C 9/26*** | (2006.01) |
| ***B65C 9/18*** | (2006.01) |

(52) U.S. Cl.

CPC ..... *B65C 9/46* (2013.01); *B65C 9/02* (2013.01); *B65C 9/1865* (2013.01); *B65C 9/26* (2013.01)

(58) Field of Classification Search

USPC ..... 156/384, 387

See application file for complete search history.

(56) References Cited

U.S. PATENT DOCUMENTS

| | | | |
|---|---|---|---|
| 5,829,351 | A | 11/1998 | Anderson et al. |
| 6,179,030 | B1 | 1/2001 | Rietheimer |
| 6,257,294 | B1 | 7/2001 | Weisbeck |
| 6,349,755 | B1 | 2/2002 | Sardo |
| 6,427,746 | B1 | 8/2002 | Anderson et al. |
| 6,792,992 | B2 | 9/2004 | Goetz |
| 6,830,642 | B2 | 12/2004 | Greenhill et al. |

(Continued)

FOREIGN PATENT DOCUMENTS

| | | | |
|---|---|---|---|
| AU | 2012261485 | A1 | 1/2013 |
| EP | 1 064 201 | B1 | 6/2003 |

(Continued)

OTHER PUBLICATIONS

"MOTOHEAD™ High Speed Labeler," LABELPAC—Reliable Labeling Solutions, ©2018, Windsor, Ontario, Canada, <http://www.labelpac.com/products/motohead> [retrieved Aug. 9, 2018], 2 pages.

(Continued)

*Primary Examiner* — Sing P Chan

(74) *Attorney, Agent, or Firm* — Christensen O'Connor Johnson Kindness PLLC

(57) ABSTRACT

A printer assembly (30) for applying labels (36) on produce P being transported on a conveyance system (24). The printer assembly receives labels (36) mounted on a substrate tape (34) from a label supply (32) and prints content on the labels pertaining to the produce being transported. An accumulator (42), together with the printer (40), are mounted on a chassis (60). The accumulator receives labels from the printer, temporarily stores a variable number of the printed labels and supplies the stored labels as needed to an applicator (44). The applicator removes the labels from the substrate tape and applies the labels on the produce as the produce is being transported by the conveyance system. The accumulator accommodates the difference in the operational speeds of the printer relative to the applicator.

24 Claims, 9 Drawing Sheets

(56) References Cited

U.S. PATENT DOCUMENTS

| | | | |
|---|---|---|---|
| 6,884,312 | B2 | 4/2005 | Mitchell et al. |
| 6,910,820 | B2 | 6/2005 | Baker et al. |
| 7,021,353 | B2 | 4/2006 | Constantine et al. |
| 7,168,472 | B2 | 1/2007 | Hirst et al. |
| 7,178,574 | B2 | 2/2007 | Nielsen et al. |
| 7,363,954 | B2 | 4/2008 | Sleiman et al. |
| 7,712,509 | B2 | 5/2010 | Constantine |
| 7,837,823 | B2 | 11/2010 | Griffin et al. |
| 8,011,405 | B2 | 9/2011 | Sleiman et al. |
| 8,066,044 | B2 | 11/2011 | Lichtenberg et al. |
| 8,110,064 | B2 | 2/2012 | Arrington et al. |
| 8,114,240 | B2 | 2/2012 | Arrington et al. |
| 8,152,063 | B1 | 4/2012 | Grant et al. |
| 8,157,946 | B2 | 4/2012 | Arrington et al. |
| 8,196,827 | B1 | 6/2012 | Grant |
| 8,464,771 | B2 | 6/2013 | Howarth et al. |
| 9,457,587 | B2 | 10/2016 | Howarth et al. |
| 2002/0138355 | A1 | 9/2002 | Briggs et al. |
| 2004/0112520 | A1 | 6/2004 | Hanschen et al. |
| 2004/0186790 | A1 | 9/2004 | Briggs et al. |
| 2008/0071618 | A1* | 3/2008 | Weisz ..... G01G 19/4144 705/14.26 |
| 2017/0043897 | A1 | 2/2017 | Mooneyham et al. |
| 2017/0320335 | A1 | 11/2017 | Wooldridge et al. |
| 2018/0002054 | A1 | 1/2018 | Kavchok |
| 2018/0290780 | A1* | 10/2018 | Kelso ..... B65C 9/26 |

FOREIGN PATENT DOCUMENTS

| | | | |
|---|---|---|---|
| EP | 163 155 | B1 | 8/2003 |
| EP | 1 067 360 | B1 | 4/2007 |
| EP | 1 928 751 | B1 | 10/2011 |
| EP | 1 750 925 | B1 | 8/2013 |
| EP | 2 399 833 | B1 | 8/2013 |
| EP | 3 204 304 | A1 | 8/2017 |
| MX | PA06009966 | A1 | 3/2007 |
| MX | 2010012155 | A1 | 12/2010 |
| WO | 99/46170 | A1 | 9/1999 |
| WO | 2005/042350 | A2 | 5/2005 |
| WO | 2009/146191 | A2 | 12/2009 |
| WO | 2016/032559 | A1 | 3/2016 |
| WO | 2016/057059 | A1 | 4/2016 |

OTHER PUBLICATIONS

International Search Report and Written Opinion dated Oct. 7, 2019, issued in corresponding International Patent Application No. PCT/US2019/037899, filed Jun. 19, 2019, 12 pages.

* cited by examiner

PRODUCE LABEL PRINTER AND APPLICATOR

BACKGROUND

The present disclosure pertains to systems for printing and applying labels, and more particularly to the printing and application of vinyl labels for produce.

Produce (fruits and vegetables) are typically required to be identified from the time of harvest to the time at which the consumer purchases the produce. Use of adhesive-backed labels, typically vinyl labels, is one means of identifying such produce.

For food safety, inventory control, etc., variable data is required on the identifying label. This variable data can include date codes, lot codes, etc. Such labels are typically pre-printed in rolls on a printing press at a printing facility, with all of the labels of a particular roll being identical. This requires many different rolls of labels to be maintained in inventory so as to be applicable to the particular produce. Moreover, oftentimes all of the labels in a roll are not needed, and may not be usable for future produce. Accordingly, waste of unused labels could occur. Even if the labels are usable in the future, it is still necessary to store and inventory the unused labels. If numerous types of produce are being processed, this can be a burdensome task.

The present disclosure provides for the printing of labels, or the printing of partially pre-printed labels, to provide variable information on the label near the point of application. The data/information to be applied to the label can be transmitted to the label printer via control system, either by hardwire connection or by wireless transmission. As such, the content of labels may be easily changed so as to be germane to the produce being labeled.

One challenge in printing labels at or near the point of application is that the speed of operation of the printer may not coincide with the speed of operation of the label applicator. Moreover, the label applicator may operate intermittently due to produce not reaching the applicator in a uniform manner. Also, printers typically operate better in a continuous or batch basis. However, it is difficult to have the output of the printer coincide with the rate of label application by the applicator. The present disclosure addresses this problem.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A printer assembly for an apparatus for applying labels on produce being transported on a conveyance system. The apparatus includes a label supply for supplying unprinted or partially printed labels mounted on a substrate tape. The apparatus also includes an applicator for receiving the labels from the printer assembly, removing the labels from the substrate tape, and applying the removed labels on the produce as the produce is being transported by the conveyance system.

The printer assembly compensates for the difference in speed of the operation of the printer relative to the speed of operation of the applicator. The printer assembly comprises: (a) a printer for receiving the labels from the label supply and printing content on the labels pertaining to the produce being transported; (b) an accumulator receiving the printed labels from the printer, temporarily storing a variable number of labels that have been printed by the printer and supplying the stored labels as needed to the applicator; and (c) a chassis on which the printer and accumulator are mounted to form a printer assembly unit. This printer assembly unit can be retrofitted on existing label applicator machines that use preprinted labels.

In a further aspect of the printer assembly, a control system is provided to initiate and terminate operation of the printer based on the number of labels stored in the accumulator.

In a further aspect of the present disclosure, the accumulator comprises a pair of spaced-apart spanner assemblies and a take up assembly relatively movable toward and away from the spanner assemblies, with the substrate tape threaded about the spanner assemblies and take up assembly, and with the distance between the take up assembly and the pair of spanner assemblies corresponding to the quantity of labels held by the accumulator.

In a further aspect of the present disclosure, the pair of spaced-apart spanner assemblies and the take up assembly are relatively movable toward and away from each other in the upright direction.

In a further aspect of the present disclosure, the spaced-apart spanner assemblies and take up assembly are relatively movable toward and away from each other under the influence of gravity.

In a further aspect of the present disclosure, the spaced-apart spanner assemblies and/or the take up assembly are mounted on a carriage for free or anti-friction movement along the accumulator. The accumulator includes portions defining one or more guideways along which the carriage travels.

In a further aspect of the present disclosure, the spaced-apart spanner assemblies and/or take up assembly include rollers to engage the substrate tape.

The present disclosure also includes an apparatus for printing and applying labels on produce being transported on a conveyance system, the apparatus comprising:

(a) a label supply for supplying unprinted or partially printed labels mounted on the substrate tape;

(b) a printer for receiving the labels from the label supply, and printing content on the labels pertaining to the produce being transported at an operational rate of a maximum specific number of labels per unit time;

(c) an accumulator for receiving the printed labels from the printer;

(d) an applicator retrieving the labels from the accumulator, removing the labels from the substrate tape and applying the removed labels on the produce as the produce is being transported by the conveyance system at an operation rate of a maximum specific number of labels per unit time which differs from the maximum rate that the printer can print content on labels; and (e) when the accumulator receives labels from the printer, it temporarily stores a variable number of labels that have been printed by the printer and supplies the stored labels as needed to the applicator to compensate for the difference in the operational rates of the printer relative to the applicator.

In a further aspect of the present disclosure, the apparatus includes a control system to, among other functions, initiate and terminate operation of the printer based on the number of labels stored in the accumulator.

In a further aspect of the present disclosure, the accumulator accommodates a variable length of substrate tape.

In a further aspect of the present disclosure, the accumulator comprises a pair of spaced-apart spanner assemblies and the take up assembly movable relative toward and away from the spanner assemblies, the substrate tape threaded on the spanner assemblies and the take up assembly with the distance between the take up assembly and the pair of spanner assemblies corresponding to the quantity of labels held by the accumulator.

In a further aspect of the present disclosure, the control system is provided to initiate operation of the printer when the pair of spaced-apart spanner assemblies and take up assembly are at a selected minimum set distance from each other and to cease operation of the printer when the pair of spaced-apart spanner assemblies and the take up assembly are at a selected maximum set distance from each other.

In a further aspect of the present disclosure, the pair of spaced-apart spanner assemblies and the take up assembly are relatively movable toward and away from each other in an upright direction.

In a further aspect of the present disclosure, the pair of spaced-apart spanner assemblies and the take up assembly are relatively movable away from each other under the influence of gravity.

In a further aspect of the present disclosure, the spaced-apart spanner assemblies and/or the take up assembly are mounted on a carriage to facilitate movement along the accumulator. Further, the accumulator has portions defining one or more guideways along which the carriage travels.

In a further aspect of the present disclosure, the spaced-apart spanner assemblies and/or the take up assembly comprise rollers to engage the substrate tape. Further, the spaced-apart spanner assemblies and/or the take up assembly are mounted on a carriage for free movement along the accumulator. In addition, the accumulator has portions defining one or more guideways along which the carriage travels thereby defining the paths of travel of the spanner assemblies and/or take up assembly.

In a further aspect of the present disclosure, the accumulator comprises 1+N laterally spaced-apart spanner assemblies, and N take up assemblies, with one take up assembly matched with each pair of adjacent spanner assemblies. The pairs of spaced-apart spanner assemblies and associated take up assembly are relatively movable toward and away from each other in an upright direction and/or under the influence of gravity.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
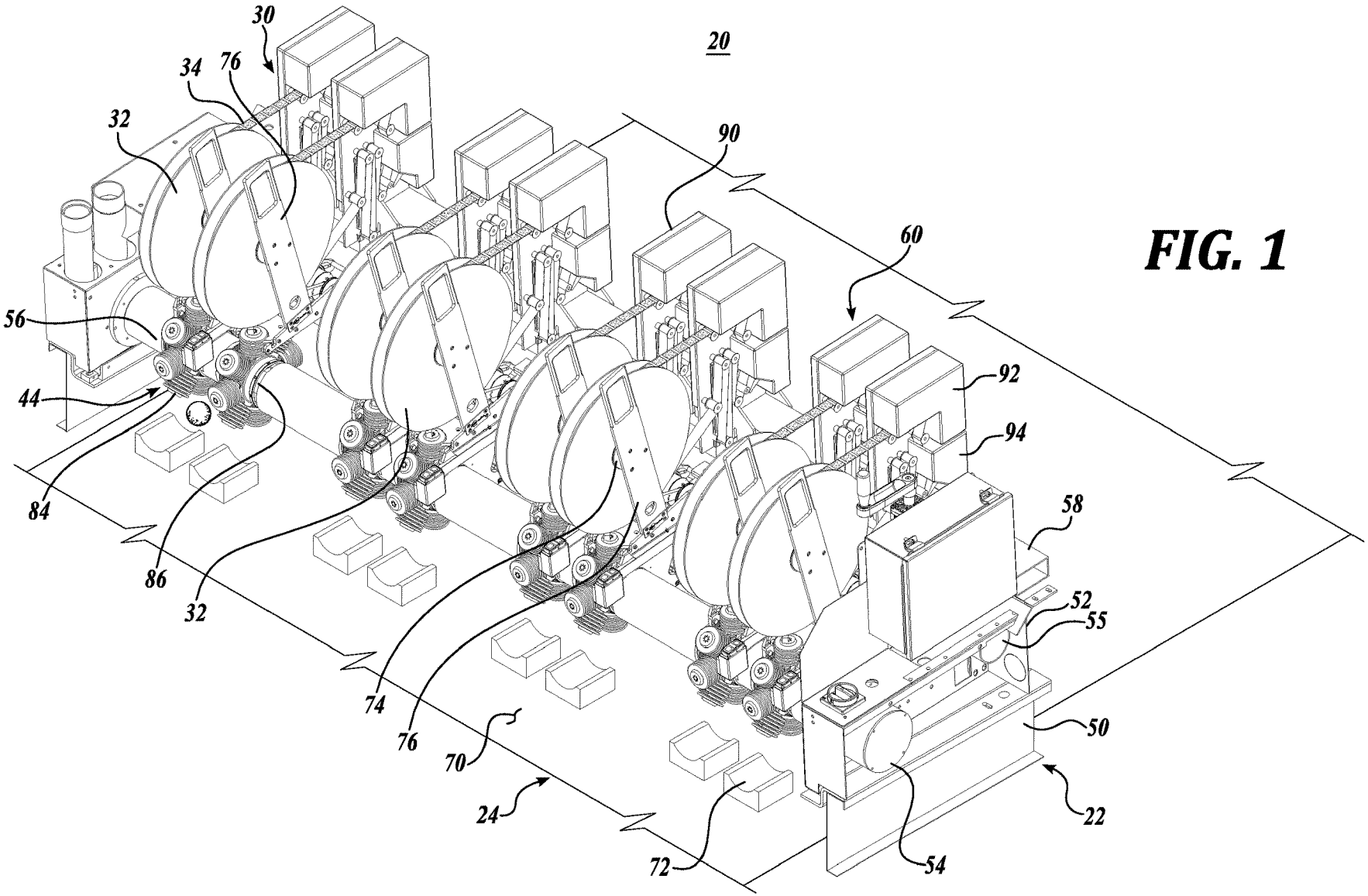
FIG. 1 is a pictorial view of the apparatus of the present invention.
Figure 2:
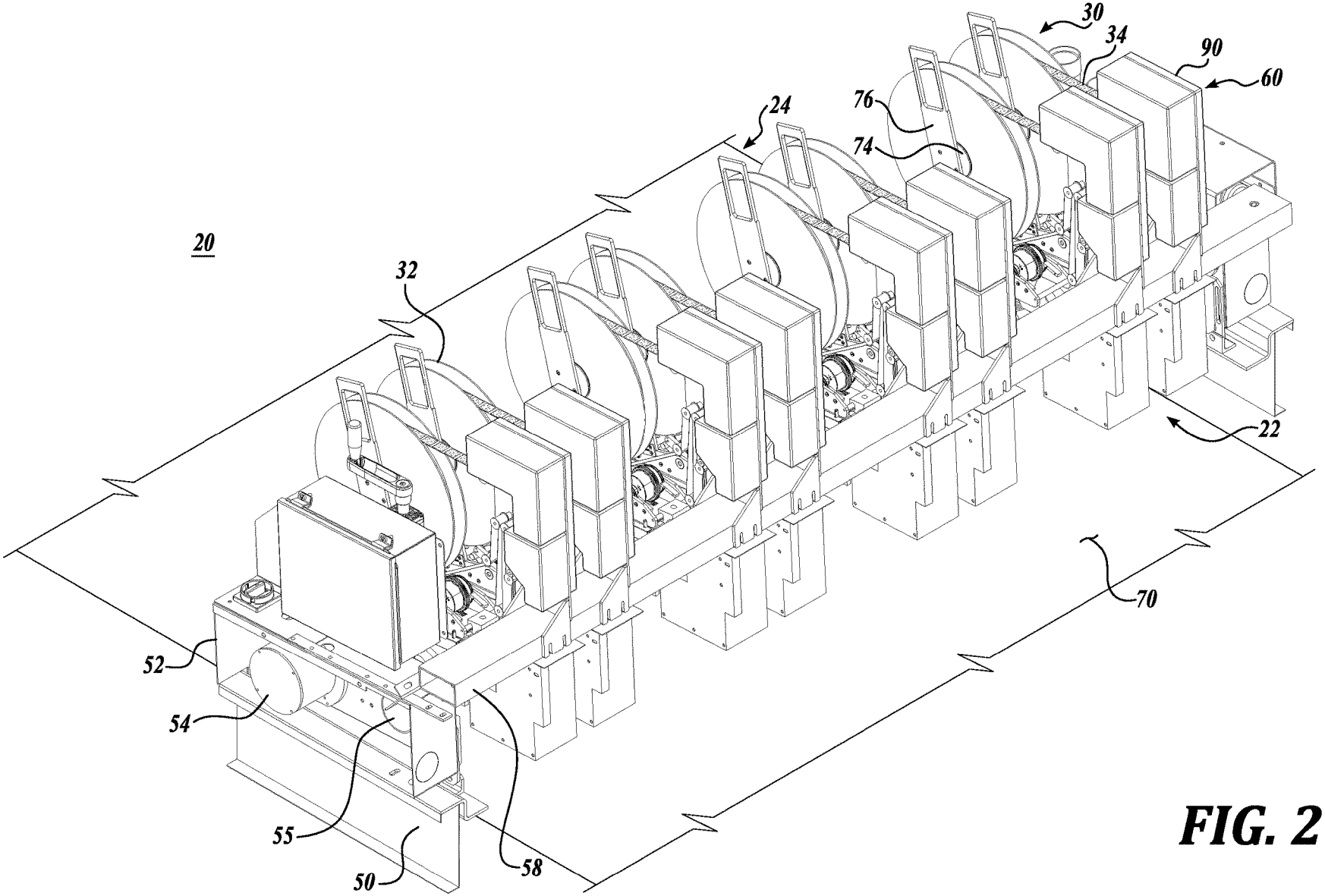
FIG. 2 is a pictorial view of the apparatus of the present invention taken from the opposite side of the apparatus relative to FIG. 1.
Figure 3:
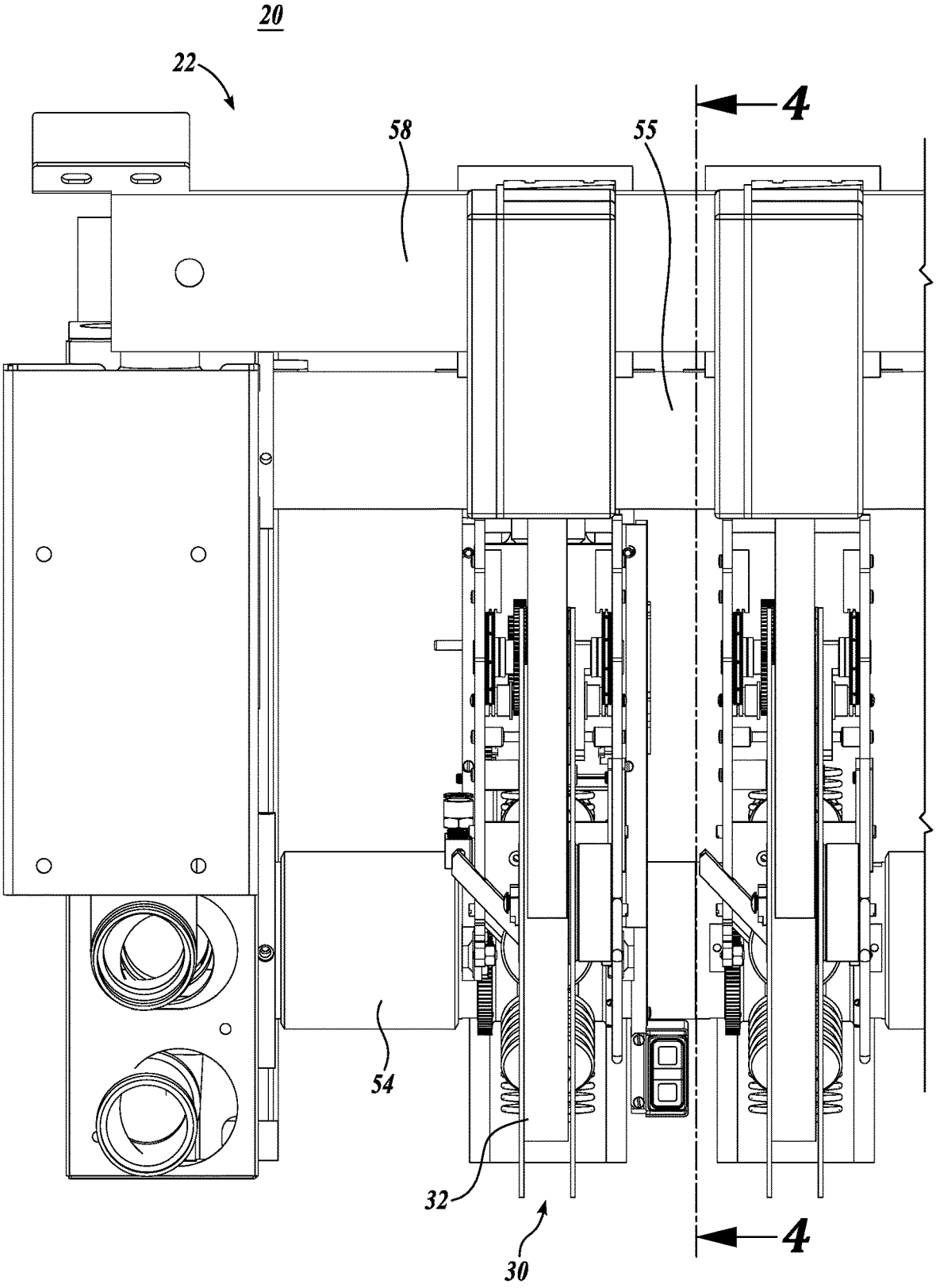
FIG. 3 is a fragmentary top view of FIGS. 1 and 2.
Figure 4:
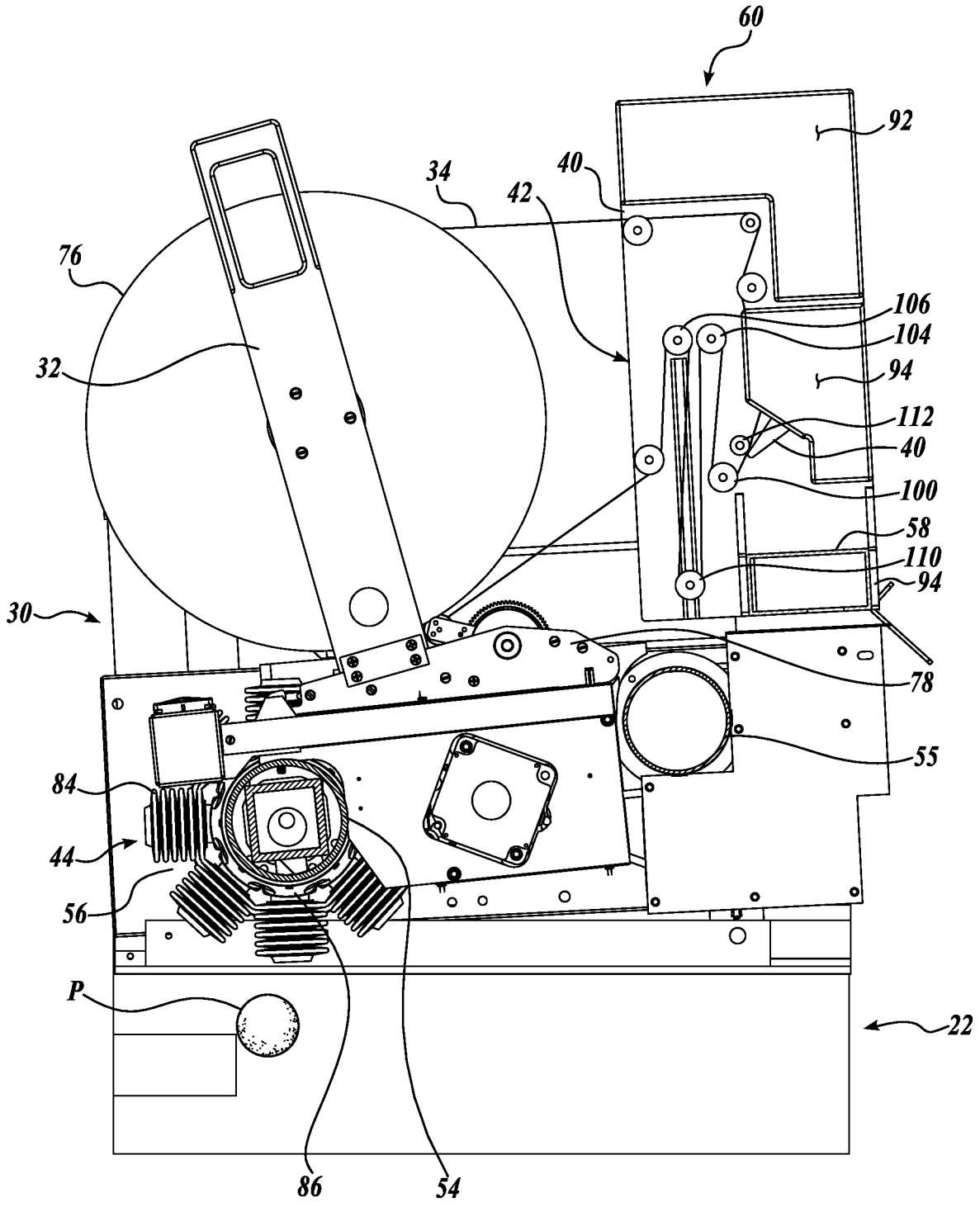
FIG. 4 is a fragmentary enlarged side elevational view taken along lines 4-4 of FIG. 3.
Figure 5:
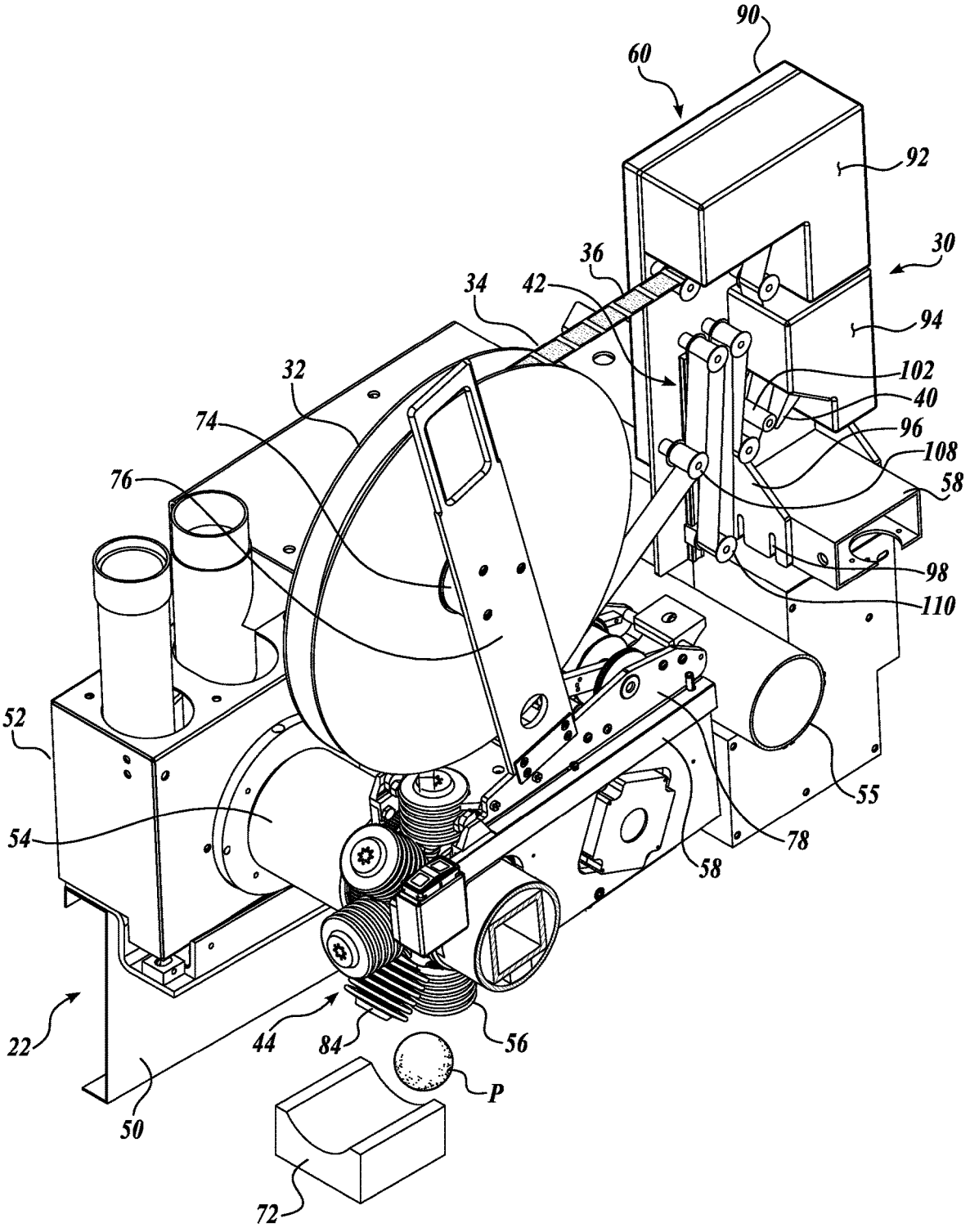
FIG. 5 is a pictorial view of FIG. 4 taken from above the apparatus.

The description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well known process steps have not been described in detail in order not to unnecessarily obscure various aspects of the present disclosure. Further, it will be appreciated that embodiments of the present disclosure may employ any combination of features described herein.

The present application may include references to "directions," such as "forward," "rearward," "front," "back," "ahead," "behind," "upward," "downward," "above," "below," "horizontal," "vertical," "top," "bottom," "right hand," "left hand," "in," "out," "extended," "advanced," "retracted," "proximal," and "distal." These references and other similar references in the present application are only to assist in helping describe and understand the present disclosure and are not intended to limit the present invention to these directions.

The present application may include modifiers such as the words "generally," "approximately," "about," or "substantially." These terms are meant to serve as modifiers to indicate that the "dimension," "shape," "temperature," "time," or other physical parameter in question need not be exact, but may vary as long as the function that is required to be performed can be carried out. For example, in the phrase "generally circular in shape," the shape need not be exactly circular as long as the required function of the structure in question can be carried out.

In the following description and in the accompanying drawings, corresponding systems, assemblies, apparatus and units may be identified by the same part number, but with an alpha suffix. The descriptions of the parts/components of such systems assemblies, apparatus, and units that are the same or similar are not repeated so as to avoid redundancy in the present application.

Referring initially to FIGS. 1-5, an apparatus 20 for printing and applying labels to produce P is illustrated as including a frame structure 22 spanning across a multi-lane conveyor 24. The frame structure 22 supports a plurality of print-and-apply assemblies 30 for printing labels 36 and then applying the labels to produce P being transported on the conveyor 24. The print-and-apply assemblies 30 include in basic form a label supply in the form of a reel or cassette 32 on which is wound a substrate or tape 34 along which are sequentially mounted adhesive backed labels 36. The tape 34 passes through a printer 40, which prints text and/or graphics or other content onto the labels 36, which may be initially blank or partially blank. From the printer 40, the tape 34 advances to an accumulator 42 which is capable of accumulating and temporarily storing a variable length of the tape 34, and thus a variable number of labels 36 that have been printed by the printer 40. From the accumulator 42, the tape 34 advances to a bellows wheel applicator 44 positioned above conveyor 24 to apply the printed labels onto the produce P passing below. The various aspects of the apparatus 20, introduced above, are described in more detail below.

The frame structure 22 includes side channels 50 extending along the lateral sides of the apparatus, outwardly of and parallel to conveyor 24. The frame channels 50 support overhead mounting box structures 52 to which the ends of a first cross tube structure 54 and a second cross tube structure 55 are connected. The first cross tube functions in part to provide a source of pressurized air for the bellows wheel assembly 56 of the label applicator 44, as discussed more fully below. The mounting box structure also supports the ends of a tubular rectangular-shaped cross member 58 which carries the chassis 60 on which the printer 40 and accumulator 42 are mounted, as discussed more fully below. It is to be understood that the frame structure 22 can be of various constructions from that described above while performing the needed function of the frame structure.

The conveyor 24 may be of standard construction and operation, being composed of a flexible conveyor belt 70 that is adapted to receive and retain produce in longitudinal paths along the length of the belt. In this regard, transverse dividers may extend across the belt to define cells for receiving the produce to be labeled. In another construction, cups or cradles 72 are mounted on the belt 70 for receiving and containing/retaining the produce while being transported. The figures illustrate that the conveyor 24 is designed to transport eight lanes of produce P that are all labeled using the present apparatus of the present disclosure. Of course the number of lanes of produce can vary, which simply changes the number of print and apply assemblies 30 that are needed.

The label reel or cassette 32 is supported for rotation above label applicator 44 by mounting axle 74 that projects from an upright mounting arm 76 extending upwardly from a bracket 78, which in turn is supported by the cross tube structures 54 and 55 of the frame 22. See, in particular, FIG. 4. The reel 32 is retained for rotation on the axle 74 by any appropriate means while being conveniently removable from the axle 74.

As shown in the drawings and as noted above, the label applicator 44 is located below and in alignment with the reel 32. The label applicator 44 is of known construction, for example, as disclosed in U.S. Pat. No. 5,829,531, incorporated herein by reference. To this end, the applicator 44 is constructed with a plurality of bellows 84 which project outwardly from a hub structure 86 which is rotatably mounted with respect to cross tube structure 54. In a known manner, the printed labels 36 are transferred from tape 34 to the distal ends of the bellows 84 and thereafter when the bellows rotate to be in registry with produce P, the bellows are expanded to press the label against the produce and thereby effecting transfer of the label to the produce. The bellows are expanded by applying air pressure thereto, with the pressurized air being routed to the applicator 44 through the cross tube structure 54 as described in U.S. Pat. No. 5,829,351. Once the label 36 has been applied to the produce P, the bellows 84 is allowed to retract to nominal condition for receipt of a further label 36 and then application of that label to the produce. The applicator 44 is illustrated as constructed with eight bellows 84, but a larger number or a fewer number of bellows may be utilized.

As is known in the applicable technology, the applicator 42 is able to sense if a passing produce cup or cradle 72 is empty, whereupon the applicator waits for the next produce item to come into registry with the applicator so that a label can be applied. As such, the operation of the applicator 44 is not always continuous, but operates intermittently in the sense that labels 36 are applied when produce is present. Also, the applicator 44 is capable of a maximum operational speed, even when all of the produce cups or cradles are filled with produce, which speed may be different than the operational speed of the printer 40.

Next, primarily referring to FIGS. 4, 5, 6A and 6B, the printer 40 and accumulator 42 are mounted together on an upright chassis 60. This enables the printer and accumulator to be retrofitted onto existing labeling installations that only had used preprinted labels. In the present situation, the chassis 60 is mounted to cross member 58 by a pair of brackets 96 extending laterally from the plane of the base 90 to overlap opposite side edges of the cross member 58. The brackets 96 are attached to the cross member 58 by standard hardware members (not shown), for example bolts, extending through slots 98 extending upwardly from the bottom edge of the brackets 96, to engage openings formed in the side walls of the cross member. The slots 98 have closed upper ends that bear downwardly against the hardware mounting members. This construction enables the chassis 60, together with the printer 40 and accumulator 42, to be conveniently removed and replaced as required by simply loosening the hardware members and lifting the chassis upward away from the cross member 58.

The chassis 60 includes an upright base 90, and an upper housing 92 for containing the components of a control system which functions to operate and control the print-and-apply assembly 30. As shown in the figures, the upper housing 92 is generally L-shaped, and borders the upper edge and the upper portions of the side edges of the base 90.

A second housing 94 is positioned below the upper housing 92 to contain the printer 40 used to print the labels 36. The printer 40 can be of various types, including for example, a thermal printer that creates text or images on the label by applying heat to the label P as the label passes through the printer 40. Such thermal printers are well known in the art.

The label substrate or tape 34 is routed from the reel 32 by guide rollers 95*a*, 95*b* and 95*c* to the printer 40. These guide rollers help eliminate any slack in the substrate or tape so that the substrate or tape feeds correctly into the printer and remain threaded on the guide rollers. In this regard, a larger number of guide rollers could be use than shown in the drawings.

After the labels are printed, they are routed to accumulator 42, which in one form of the present disclosure is composed of a series of stationary and moving pulleys mounted on the chassis base 90 at a location between the printer 40 and the applicator 44 as shown in the figures.

The accumulator 42 includes a first guide roller 100 located adjacent the platen roller 102 of the printer 40. The accumulator also includes a pair of upper idler rollers 104 and 106 which are laterally spaced apart from each other and mounted on the chassis base 90. An exit guide roller 108 is located below and somewhat laterally to the idler roller 106 to guide the tape 34 from the accumulator to the applicator 44.

Figure 7:
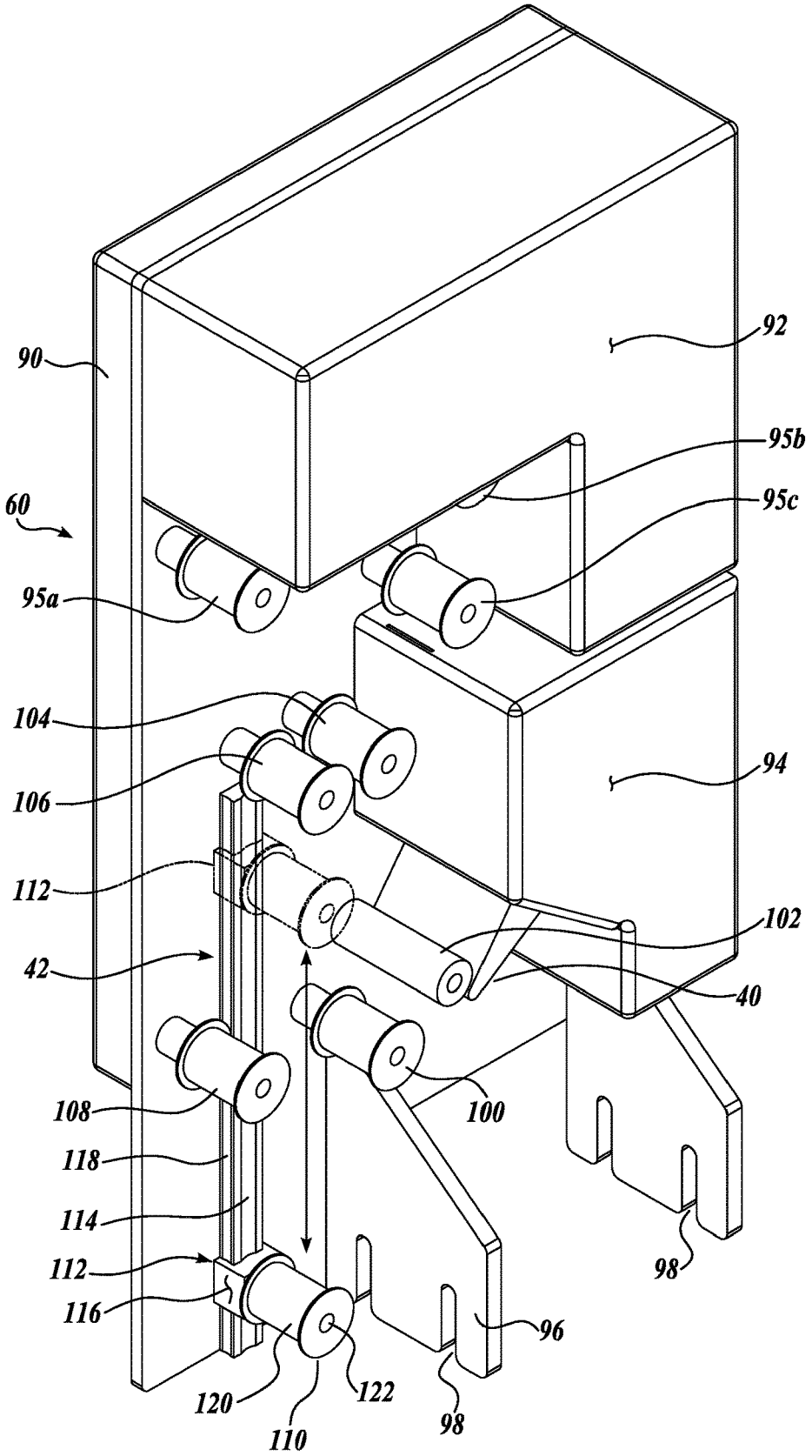
FIG. 7 is a pictorial view of FIGS. 6A and 6B with the substrate or carrier ribbon removed.

Between the two idler rollers 104 and 106, the tape 34 is threaded around a sliding take-up roller assembly 110 which is constructed to move up and down relative to the stationary idler rollers 104 and 106 which function as spanners around which the tape 34 is threaded. The take-up roller assembly 110 is mounted on a carriage 112 that engages with an upright or vertical slideway 114, see in particular FIG. 7. The carriage 112 is designed with side flange portions 116 that engage with concave, contoured side edges 118 of the slideway 114. In this manner, the side flanges 116 of the carriage are held engaged with the slideway 114 but are capable of freely sliding up and down along the length of the slideway. Of course the slideway can be of other constructions, for example in the form of a slot formed in the chassis base 90.

Figure 6A:
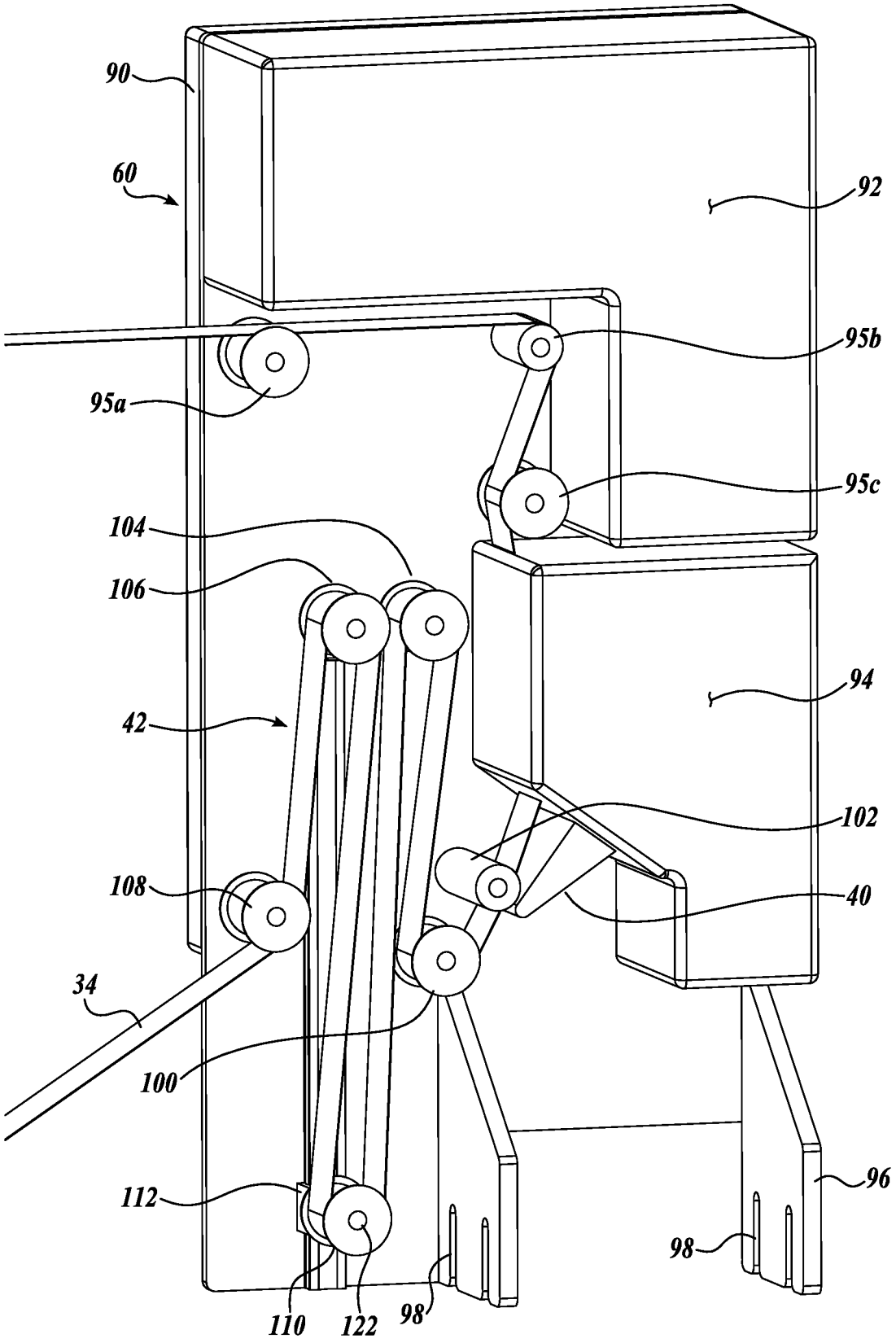
FIG. 6A is an enlarged fragmentary pictorial view of the printer and accumulator shown in FIG. 4 as mounted on a common chassis.
Figure 6B:
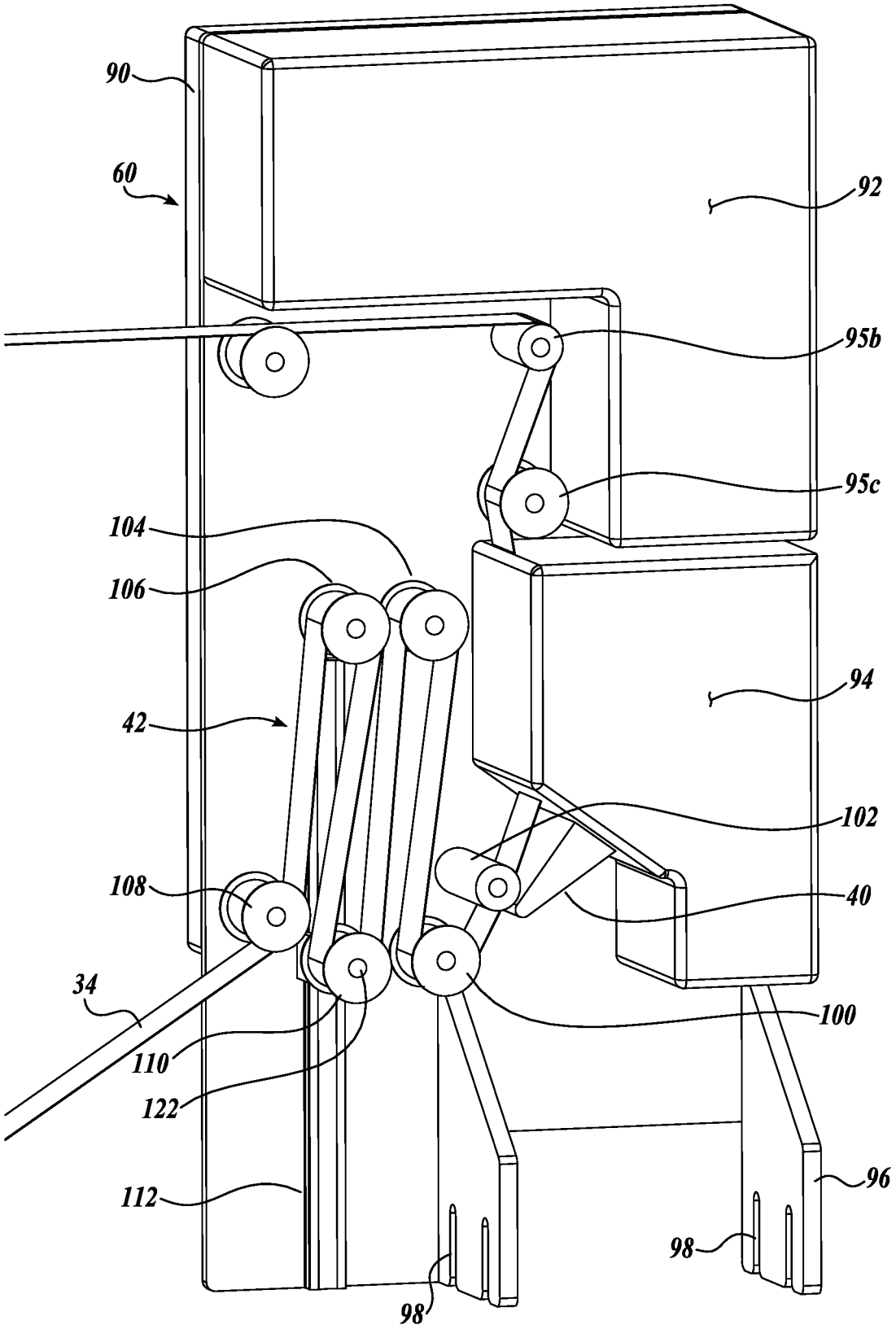
FIG. 6B is a view similar to FIG. 6A but with the accumulator in a different condition.

The take-up roller assembly 110 includes a spindle roller 120 that is mounted on an axle 122 projecting from the carriage 112. The spindle roller 120, axle 122, and carriage 112 are constructed with sufficient mass so that the take-up roller assembly 110 is biased to move downwardly along the length of the slideway 114 under the influence of gravity. Although the slideway 114 is shown as substantially vertical, it need not be exactly vertical, but desirably is disposed in a sufficiently upright orientation so that the take-up roller assembly 110 places a desired tension or load on the tape 34 as the tape travels through the accumulator, whether the take-up roller assembly 110 is in substantially lowered position as shown in FIG. 6A, or disposed in a more elevated position as shown in FIG. 6B. Any slack in the tape 34 is eliminated by the downward load applied to the tape by the take-up roller assembly 110.

It will be appreciated that the accumulator 42 functions to accommodate differences in the operational speed of the applicator 44 relative to the printer 40. If the printer 40 is operating at a net operational speed that exceeds the net operational speed of the applicator, then the extra labels 36 are temporarily accommodated or stored in the accumulator. In this regard, the take-up roller assembly 110 moves in the downward direction as an initial length of the tape 34 accumulates in the accumulator. At a certain point, when the take-up roller assembly 110 travels toward the bottom end of the slideway 114 as shown in FIG. 6A, the printer 40 is disabled so as to discontinue printing the labels 36. Subsequently, as the labels 36 are applied to produce P by the applicator 44, the take-up roller assembly 110 rides upwardly along the slideway 114 due to the removal of the labels from the accumulator. When the carriage 112 reaches a predetermined elevation along the height of the slideway 114, the printer is rendered operational so as to initiate printing of the labels 36.

It will be appreciated that the accumulator 42 is useful in accommodating differences in the rate at which labels 32 are printed relative to the speed at which labels are applied to produce P. Such difference in operational speed may be due to the inherent operational speeds of the printer 40 versus the applicator 44, as well as due to empty cradles or cups 72 in the flow of produce P passing by the print-and-apply assembly 30. An empty cradle or cup will cause the applicator to momentarily stop until the next item of produce reaches the applicator If the printer 40 is capable of operating at a faster speed than the applicator 44, printed labels 36 will tend to accumulate in the accumulator 42 until the accumulator is in full condition whereupon the printer is inactivated. Also printers operate best at a constant speed. To accommodate this, the printer 40 typically operates to print a batch of labels at a constant speed until the accumulator is full and then the printer stops until the accumulator has been emptied sufficiently to enable the printer to print a further batch of labels.

The present apparatus 20 can also function in situations where the applicator 44 is capable of operating at a faster speed than the printer 40. Typically the cups/cradles 72 along a conveyor are at most about 90% filled. As such, the accumulator 42 must momentarily stop at an empty cradle or cup. During the stoppage of the applicator, printed labels 36 accumulate in the accumulator, so that when the accumulator is operating again, it can operate at a faster speed than the printer by drawing down the labels that have accumulated in the accumulator. It will be appreciated that this allows the produce P to be labeled at maximum operational speed of the printer which also coincides with the net operational speed of the applicator. If on the other hand, if accumulator 42 were not used, then the maximum operational speed of the applicator could not exceed the operational speed of the printer, which would result in a net operational speed of the accumulator being less than the maximum operational speed of the printer due to the need of the applicator to stop when an empty cup/cradle occurs. Thus, the present apparatus enables the produce to be labeled at the maximum speed possible, wherein the limiting factor of such speed is the maximum speed of operation of the label printer.

It will also be appreciated that the accumulator 42 performs the additional function of enabling a relatively constant tension to be applied to the tape, not only between the reel and the printer, but also between the printer and the applicator. This reduces the likelihood that the tape may become twisted or otherwise out of alignment or out of registry with the printer or the applicator.

Figure 8:
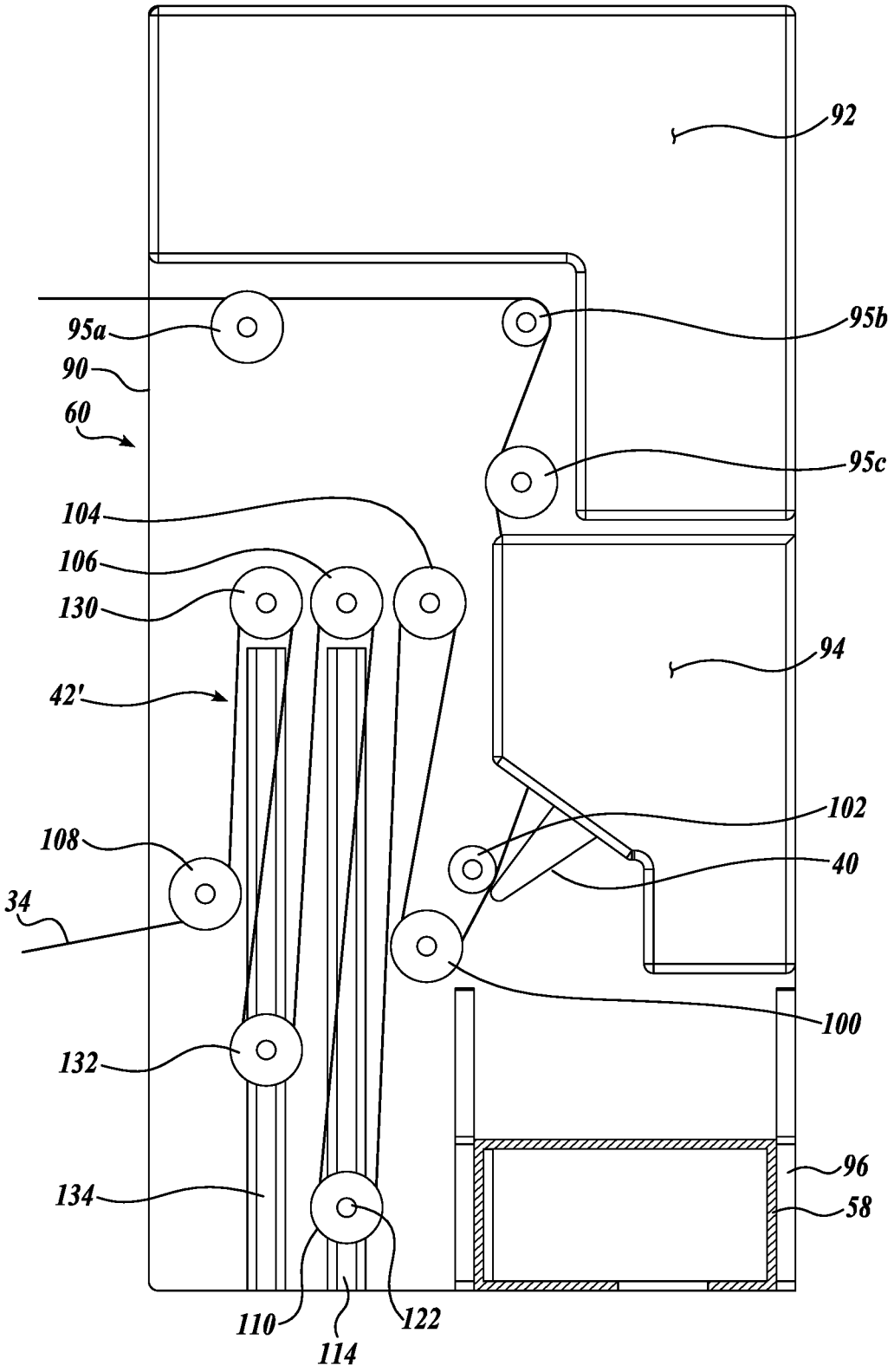
FIG. 8 is a side elevational view of a further disclosure of the present invention.

A further embodiment of the present disclosure is shown in FIG. 8 wherein the components that are the same or similar to those shown in FIGS. 1-7 are identified with the same part number. The construction and operation of such components will not be repeated here. The major difference between the embodiment of FIG. 8 and the embodiment of FIGS. 1-7 is the construction of the accumulator 42'. As shown in FIG. 8, the accumulator 42', as in the accumulator 42 of FIGS. 1-7, includes guide roller 100 adjacent the printer 40 for receiving the tape 34 from the printer and directing the tape to upper idler roller 104. Accumulator 42' does differ from accumulator 42 in that three upper idler rollers 104, 106 and 130 are utilized. This arrangement enables the use of two take-up roller assemblies 110 and 132, with the take-up roller assembly 110 associated with upper idler rollers 104 and 106 and the second take-up roller assembly 132 associated with upper idler rollers 106 and 130. As in accumulator 42, accumulator 42' includes an exit guide roller 108 to guide the tape from the upper idler roller 130 to the applicator 44. It will be appreciated that in the accumulator 42', the take-up roller assembly 132 is constructed the same or very similar to the take-up roller assembly 110, with a carriage that can be the same as carriage 112 engaged with a slideway 134. Because the accumulator 42' utilizes two take-up roller assemblies 110 and 132, the capacity of the accumulator 42' is increased from the accumulator 42 shown in FIGS. 1-7.

The accumulator 42' can be designed so that when one of the take-up rollers 110 or 132 reaches a desired upward position, it bears against a stop that prevents further upward movement of the take-up roller 110 or 132. A switch can be associated with the other take-up roller 110 or 132 so that when such other take-up roller travels to a preset upward position, the printer is activated to begin printing labels.

The switch(es) 65 associated with the accumulator 42 or 42' can be of various construction. For example, the switch (es) 65 can be designed to sense the vertical height or position of the carriage 112. Various types of switches may be employed, for example, a limit switch, a proximity switch, an optical switch, etc. Such switches are articles of commerce.

While illustrative embodiments have been illustrated and described, it will be appreciated that various changes can be made therein without departing from the spirit and scope of the invention. In this regard, the chassis 60 may be retrofitted onto existing labeling stations other than by use of flanges 96. It will be understood that it is within the capability of one skilled in the art to mount the chassis 60 at a suitable location on a pre-existing labeling apparatus.

As a further matter, the mass of the take-up roller assembly 110 can be altered so that the desired level of the downward biasing load on the tape 34 is achieved. As can be appreciated, such desired load level may depend on various factors, including for example, the speed of operation of the printer 40 and/or applicator 44 the stiffness and/or thickness of the tape 34; the length of the slideway 114; the sliding resistance of the carriage 112 along the slide way 114; and the number of take-up roller assemblies 110, 132 being used.

In addition, the biasing load applied to the tape 34 can be augmented by applying an external downward load on the take-up roller assembly 110, for example by the use of a spring or elastic band or other type of biasing mechanism.

Further, although the present disclosure has discussed the use of one or two take-up roller assemblies 110 and/or 132, a different number of take-up roller assemblies can be used, for example three or four.

The embodiments of the invention in which an exclusive property or privilege is claimed are defined as follows:

1. An apparatus for printing and applying label on produce being transported on a conveyance system, comprising:

a. a label supply for supplying unprinted or partially printed labels mounted on a substrate tape;

b. a printer for receiving the labels from the label supply and printing content on the labels pertaining to the produce being transported at an operational rate of a maximum specific number of labels per unit time;

c. an accumulator receiving the printed labels from the printer;

d. an applicator receives the labels from the accumulator, removes the labels from the substrate tape and applies the removed labels on the produce as the produce is being transported by the conveyance system at an operational rate of a maximum specific number of labels per unit time which is a different rate than the maximum rate that the printer can print content on labels; and e. the accumulator receives labels from the printer, temporarily stores a variable number of labels that have been printed by the printer and supplies the stored labels as needed to the applicator to compensate for the difference in the operational rates of the printer and the applicator; and f. a control system to initiate and terminate operation of the printer based on the number of labels stored in the accumulator.

2. The apparatus of claim 1, wherein the accumulator accommodates a variable length of the substrate tape.

3. The apparatus of claim 2, wherein the accumulator comprises a pair of spaced-apart spanner assemblies and a take up assembly movable relatively toward and away from the spanner assemblies, the substrate tape threaded about the spanner assemblies and the take-up assembly, with distance between the take up assembly and the spanner assemblies corresponding to a quantity of labels held by the accumulator.

4. The apparatus of claim 3, wherein the pair of spaced-apart spanner assemblies and the take up assembly are relatively movable toward and away from each other in the upright direction.

5. The apparatus of claim 3, wherein the spaced-apart spanner assemblies and the take up assembly are relatively movable toward and away from each other under the influence of gravity and/or a biasing mechanism.

6. The apparatus of claim 3, wherein the spaced-apart spanner assemblies and/or the take up assembly are mounted on a carriage for movement along the accumulator.

7. The apparatus of claim 6, wherein the accumulator having portions defining one or more guideways along which the carriage travels.

8. The apparatus of claim 3, wherein the spaced-apart spanner assemblies and/or the take up assembly comprise rollers to engage the substrate tape.

9. The apparatus of claim 8, wherein the spaced-apart spanner assemblies and/or the take up assembly are mounted on a carriage for movement along the accumulator.

10. The apparatus of claim 9, wherein the accumulator having portions defining one or more guideways along which the carriage travels.

11. The apparatus of claim 3, comprising 1 plus N laterally spaced-apart spanner assemblies and N take-up assemblies, with one take-up assembly associated with each pair of adjacent spanner assemblies.

12. The apparatus of claim 11, wherein the spaced-apart spanner assemblies and the associated take up assembly are relatively movable toward and away from each other.

13. The apparatus of claim 11, wherein the spaced-apart spanner assemblies and the associated take up assembly relatively movable toward and away from each other under the influence of gravity and/or a biasing mechanism.

14. The apparatus of claim 11, wherein the spaced-apart spanner assemblies and/or the associated take up assembly comprise rollers to engage the substrate tape.

15. The apparatus of claim 11, wherein the spaced-apart spanner assemblies and/or the take up assembly are mounted on a carriage for movement along the accumulator.

16. An apparatus for printing and applying label on produce being transported on a conveyance system, comprising:

a. a label supply for supplying unprinted or partially printed labels mounted on a substrate tape;

b. a printer for receiving the labels from the label supply and printing content on the labels pertaining to the produce being transported at an operational rate of a maximum specific number of labels per unit time;

c. an accumulator receiving the printed labels from the printer;

d. an applicator receives the labels from the accumulator, removes the labels from the substrate tape and applies the removed labels on the produce as the produce is being transported by the conveyance system at an operational rate of a maximum specific number of labels per unit time which is a different rate than the maximum rate that the printer can print content on labels;

e. wherein the accumulator receives labels from the printer, temporarily stores a variable number of labels that have been printed by the printer and supplies the stored labels as needed to the applicator to compensate for the difference in the operational rates of the printer and the applicator;

f. wherein the accumulator accommodates a variable length of the substrate tape;

g. wherein the accumulator comprises a pair of spaced-apart spanner assemblies and a take up assembly movable relatively toward and away from the spanner assemblies, the substrate tape threaded about the spanner assemblies and the take-up assembly, with distance between the take up assembly and the spanner assemblies corresponding to the quantity of labels held by the accumulator; and h. a control system to initiate operation of the printer when the spaced-apart spanner assemblies and the take up assemble are at a selected distance from each other and to cease operation of the printer when the spaced-apart spanner assemblies and the take up assembly are at a selected maximum distance from each other.

17. A printer assembly for an apparatus for applying labels on produce being transported on a conveyance system, the apparatus including a label supply for supplying unprinted or partially printed labels mounted on a substrate tape and an applicator for receiving the labels from the printer assembly, removing the labels from the substrate tape and applying the removed labels on the produce as the produce is being transported by the conveyance system, the printer assembly compensating for a difference in speed of operation of the printer relative to a speed of operation of the applicator, the printer assembly comprising:

a. a printer for receiving the labels from the label supply and printing content on the labels pertaining to the produce being transported;

b. an accumulator receiving the printed labels from the printer, the accumulator receives labels from the printer, temporarily stores a variable number of labels that have been printed by the printer and supplies the stored labels as needed to the applicator; and c. a chassis on which the printer and accumulator are mounted to form a printer assembly unit; and d. a control system to initiate and terminate operation of the printer based on the number of labels stored in the accumulator.

18. The apparatus of claim 17, wherein the accumulator comprises a pair of spaced-apart spanner assemblies and a take up assembly movable relatively toward and away from the spanner assemblies, the substrate tape threaded about the spanner assemblies and the take-up assembly, with distance between the take up assembly and the pair of spanner assemblies corresponding to the quantity of labels held by the accumulator.

19. The apparatus of claim 18, wherein the spaced-apart spanner assemblies and the take up assembly are relatively movable toward and away from each other in the upright direction.

20. The apparatus of claim 18, wherein the spaced-apart spanner assemblies and the take up assembly are relatively movable toward and away from each other under the influence of gravity and/or a biasing mechanism.

21. The apparatus of claim 18, wherein the spaced-apart spanner assemblies and/or the take up assembly are mounted on a carriage for movement along the accumulator.

22. The apparatus of claim 21, wherein the accumulator having portions defining one or more guideways along which the carriage travels.

23. The apparatus of claim 18, wherein the spaced-apart spanner assemblies and/or the take up assembly comprise rollers to engage the substrate tape.

24. A printer assembly for an apparatus for applying labels on produce being transported on a conveyance system, the apparatus including a label supply for supplying unprinted or partially printed labels mounted on a substrate tape and an applicator for receiving the labels from the printer assembly, removing the labels from the substrate tape, and applying the removed labels on the produce as the produce is being transported by the conveyance system, the printer assembly compensating for the difference in speed of operation of the printer relative to the speed of operation of the applicator, the printer assembly comprising:

a. a printer for receiving the labels from the label supply and printing content on the labels pertaining to the produce being transported;

b. an accumulator receiving the printed labels from the printer, the accumulator receives labels from the printer, temporarily stores a variable number of labels that have been printed by the printer and supplies the stored labels as needed to the applicator;

c. a chassis on which the printer and accumulator are mounted to form a printer assembly unit;

d. wherein the accumulator comprises a pair of spaced-apart spanner assemblies and a take up assembly movable relatively toward and away from the spanner assemblies, the substrate tape threaded about the spanner assemblies and the take-up assembly, with distance between the take up assembly and the pair of spanner assemblies corresponding to the quantity of labels held by the accumulator; and e. a control system to initiate operation of the printer when the spaced-apart spanner assemblies and the take up assemble are at a selected distance from each other and to cease operation of the printer when the spaced-apart spanner assemblies and the take up assembly are at a selected maximum distance from each other.

* * * * *